United States Patent [19]

Morishita et al.

[11] Patent Number: 4,737,654

[45] Date of Patent: Apr. 12, 1988

[54] LEVER-ASSISTED PINION IN A STARTER MOTOR

[75] Inventors: Akira Morishita; Kyohei Yamamoto, both of Hyogo, Japan

[73] Assignee: Mitsubishi Denki Kabushiki Kaisha, Tokyo, Japan

[21] Appl. No.: 15,472

[22] Filed: Feb. 17, 1987

[30] Foreign Application Priority Data

Feb. 17, 1986 [JP] Japan ..... 61-21274

[51] Int. Cl.[4] ..... F02N 11/00

[52] U.S. Cl. ..... 290/48

[58] Field of Search ..... 290/48

[56] References Cited

U.S. PATENT DOCUMENTS 4,305,002 12/1981 Mortensen ..... 290/48 X 4,418,289 11/1983 Mortensen ..... 290/48 X 4,488,054 12/1984 Ebihara ..... 290/48 X

*Primary Examiner*—William M. Shoop, Jr.

*Assistant Examiner*—W. E. Duncanson, Jr.

*Attorney, Agent, or Firm*—Sughrue, Mion, Zinn, Macpeak & Seas

[57] ABSTRACT

A starter motor in which the plunger of a solenoid switch supplying power to the starter motor also drives a lever through a return spring. The lever is connected on its other end to a pinion which moves along the output shaft of the starter motor to connect it to a ring gear of an engine to be started. The return spring biases the pinion away from the ring gear. The return spring and a drive rod acting on the lever are contained in a hollow of the solenoid plunger.

6 Claims, 2 Drawing Sheets

LEVER-ASSISTED PINION IN A STARTER MOTOR

BACKGROUND OF THE INVENTION

1. Field of the Invention

This invention generally relates to starters, and more particularly to an improvement of a return spring in a starter.

2. Background of the Invention

FIG. 1 shows one example of a conventional starter which has been disclosed, for instance, in Japanese Utility Model application (OPI) NO. 107957/1981 (the term "OPI" as used herein meaning "an unexamined published application"). In FIG. 1 a current supplying terminal M for supplies electric current to a starter 4*a*. The starter 4*a* includes a field coil 5 and an armature 6 with an output shaft 8 of the armature 6. The output shaft 8 has helical splines 8*a* formed on its cylindrical outer wall. A thrust spline member (boss) 9 is slidably mounted on the helical splines 8*a* and A pinion 10. the pinion 10 is cam-engaged with the trust spline member 9, thus forming an over-running clutch. The pinion 10 slides on the output shaft 8 to engage with a ring gear 14 of the engine to transmit the torque of the armature 6 to the engine thereby to start the engine.

Further in FIG. 1, a stopper 12 is secured to the output shaft 8 with a ring 3. A return spring 11 is mounted on the output shaft 8 in such a manner that it is located between the stopper 12 and the pinion 10. Normally the pinion 10 is biased by the return spring 11 to the left in FIG. 1, so as to be set apart from the ring gear 14.

FIG. 2 shows a general electrical circuit for a starter of this type. When a key switch 2 is turned on, current is caused to flow from a battery 1 to the switch coil 3*d* of an electromagnetic switch 3. As a result, the plunger 3*e* of the switch 3 is attracted by the switch coil 3*d* to bring a movable contact 3*c* into contact with stationary contacts 3*a* and 3*b*, i.e., to close the normally-open contact means comprising the stationary contacts 3*a* and 3*b* and the movable contact 3*c*. As a result, the voltage of the battery 1 is applied to the terminal M of the starter 4*a* shown in FIG. 1, to allow current to flow in the field coil 5 and the armature 6, so that the armature is rotated. Therefore, owing to the angle of inclination of the helical splines 8*a* of the output shaft 8 and the inertia of the thrust spline member 9 and the pinion 10, the pinion 10 is moved against the elastic force of the return spring 11 to the right in FIG. 1, to engage with the ring gear 14 of the engine to thereby start the engine.

When the key switch 2 is turned off, the movable contact 3*c* is disengaged from the stationary contacts 3*a* and 3*b* by a contact spring (not shown) as shown in FIG. 2, thereby to interrupt the energization of the starter 4*a*, while the pinion 10 is disengaged from the ring gear 14 by the elastic force of the return spring 11.

One example of a starter is disclosed in Japanese Utility Model Application Publication No. 55-41563. In this starter, a brake is disposed adjacent a slider member which is in enagreement with a helical spline. Further, a drive means is provided to actuate the brake.

Another example of a starter is disclosed in Japanese Utility Model Application Publication No. 57-36763. According to this starter, a movable shaft is provided which is actuated by an electromagnetic force of a solenoid which functions as a stop to hold the engagement between a pinion and a ring gear. Further, a contact mechanism is provided which the utilizes electromagnetic force of the solenoid.

The conventional starter is constructed as described above. Therefore, dust or water is liable to enter the starter to deposit at or around the return spring to make the sliding operation of the return spring unsatisfactory or to corrode and break it. In order to overcome these difficulties, a variety of methods have been proposed, such as for instance, a method of providing a protective cover. However, none of the methods are sufficient. Furthermore, the starter suffers from a problem that, before the engine is started completely, the pinion returns, so that the engine cannot be started. In addition, the conventional starter has the following disadvantage. Since, in order to quickly eject the pinion, it is essential to completely stop the armature, it is necessary to provide a brake device for the armature or to wait until the armature stops.

SUMMARY OF THE INVENTION

In view of the foregoing, an object of this invention is to provide a starter in which the above-described difficulties accompanying a conventional starter are eliminated. These difficulties arise because of the entrance of dust or water, and the sliding operation of the return spring is made unsatisfactory or the return spring is corroded and broken, and the pinion is returned earlier by the pulsive motion of the engine.

It is a further object of the present invention to provide a starter in which the time required for stopping the armature can be reduced.

In the starter according to the invention, a return spring for urging the pinion to move away from the engine ring gear, and a drive rod for driving a drive lever adapted to move the pinion are accommodated inside the plunger of the electromagnetic switch of the starter.

As was described above, in the starter of the invention, the return spring is provided inside the plunger of the electromagnetic switch. Therefore, the difficulties are eliminated that because of the entrance of dust or water, the sliding operation of the return spring is made unsatisfactory or it is corroded and broken and that the pinion is returned prematurely. In addition, the time required for stopping the armature can be reduced.

DETAILED DESCRIPTION OF THE PREFERRED EMBODIMENTS

Figure 3:
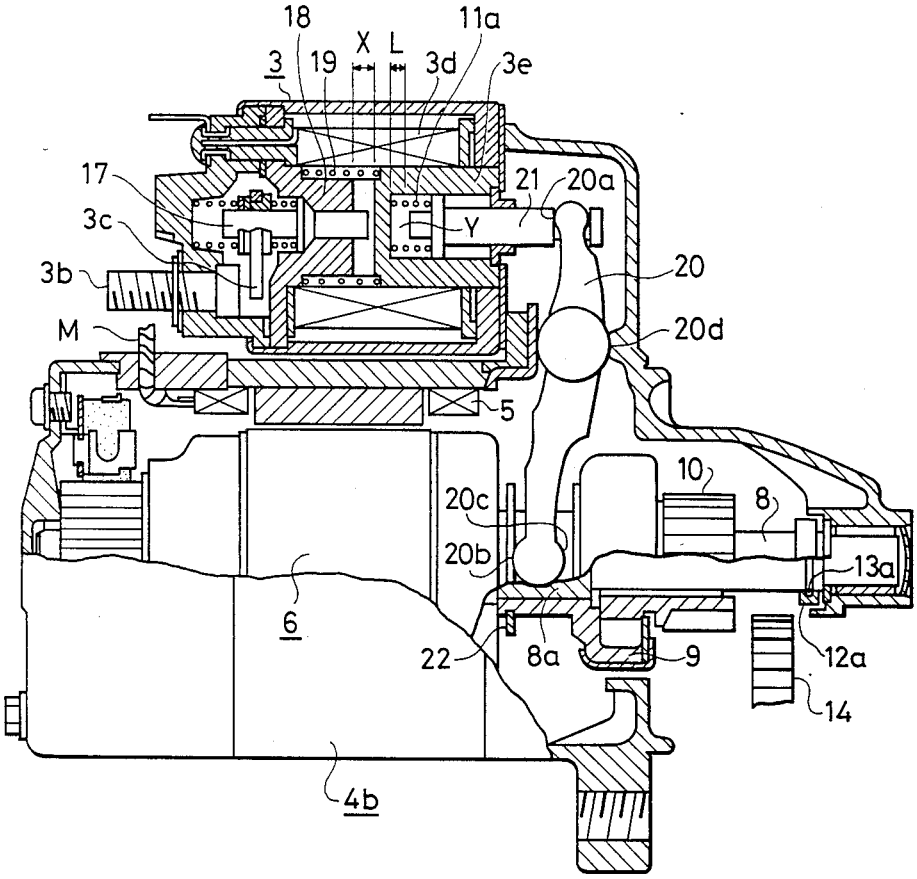
FIG. 3 is a sectional diagram showing one example of a starter according to this utility model.

FIG. 3 shows one embodiment of this invention. FIG. 3 shows a current supplying member M of a starter 4*b*. The current supplying member M is connected to the field coil 5 and the armature 6 of the starter 4*b*. An output shaft 8 of the armature has helical splines 8*a* formed on its cylindrical outer wall. A thrust spline member 9 is slidably mounted on the helical splines 8*a* of the output shaft 8. A pinion 10 is cam-engaged with the thrust spline member 9, thus forming an over-running clutch. The pinion 10 slides on the output shaft 8 to engage with the ring gear 14 of the engine to transmit the torque of the armature 6 to thereby start the engine.

Further in FIG. 3, a stopper 12*a* is secured to the shaft 8 with a ring 13*a* in order to limit the movement of the pinion 10. A electromagnetic switch 3 is mounted on the starter 4*b*. The electromagnetic switch 3 has a pair of stationary contacts 3*a* and 3*b* and a movable contact 3*c* provided on a contact rod 17 which form a normally-open contact switch. The unillustrated stationary contact 3*a* is connected to the battery and the stationary contact 3*b* is connected through the current supplying member M to the field coil 5. There is additionally a core switch 18. A plunger 3*e* of the electromagnetic switch 3 is kept energized by a plunger spring 19 to be biased to the right in FIG. 3. A switch coil 3*d* surrounds the plunger 3*e* and the core switch 18. When current is supplied to the switch coil 3*d*, the plunger 3*e* is attracted towards the core switch 18 so that the contact rod 17 is moved to the left. As a result, the movable contact 3*c* is brought into contact with both the stationary contacts 3*a* and 3*b*, thereby completing the circuit from the battery 1 to the field coil 5.

Further in FIG. 3, a drive rod 21 drives a drive lever 20 which is rockable about a fulcrum 20*d* to move the pinion 10 along the shaft 8 of the armature 6. The drive rod 21 together with a return spring 11*a* is accommodated in a hollow Y in the plunger 3*e* of the electromagnetic switch 3. The return sping 11*a* is adapted to urge the pinion 10 to move away from the ring gear 14 of the engine, as shown in FIG. 3.

Figure 2:
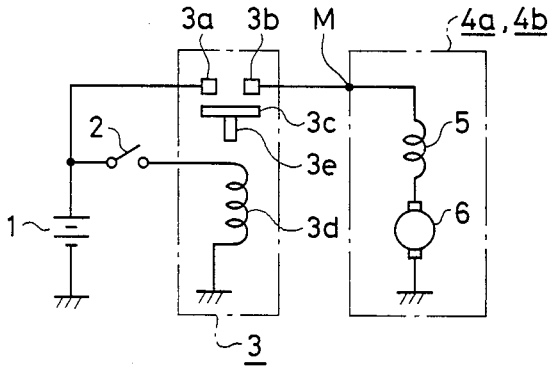
FIG. 2 is an electrical circuit diagram for a general starter.

The starter according to the invention is constructed as described above. Therefore, when the key switch 2 of FIG. 2 is turned on, current is caused to flow in the switch coil 3*d* of the electromagnetic switch 3, so that the plunger 3*e* is attracted to the left in FIG. 3, i.e., it is moved against the plunger spring 19 to move the contact rod 17 to the left, so that the movable contact 3*c* is brought into contact with the stationary contacts 3*a* and 3*b*. As a result, current flows from the battery 1 to the field coil 5 and the armature 6 of the starter 4*b* to rotate the armature 6. On the other hand, since the plunger 3*e* is moved to the left, as described above, the amount of compression of the return spring 11*a* is reduced. Therefore, the elastic force urging the drive rod 21 to the right is reduced, as a result of which the elastic force urging the pinion 10 to the left through the drive lever 20 is also reduced. When, under this condition, the armature 6 starts rotating, owing to the angle of inclination of the helical splines 8*a* of the output shaft 8 and the inertia of the thrust spline member 9 and the pinion 10, the pinion 10 is moved to the right to engage with the ring gear 14 of the engine to start the latter.

Figure 1:
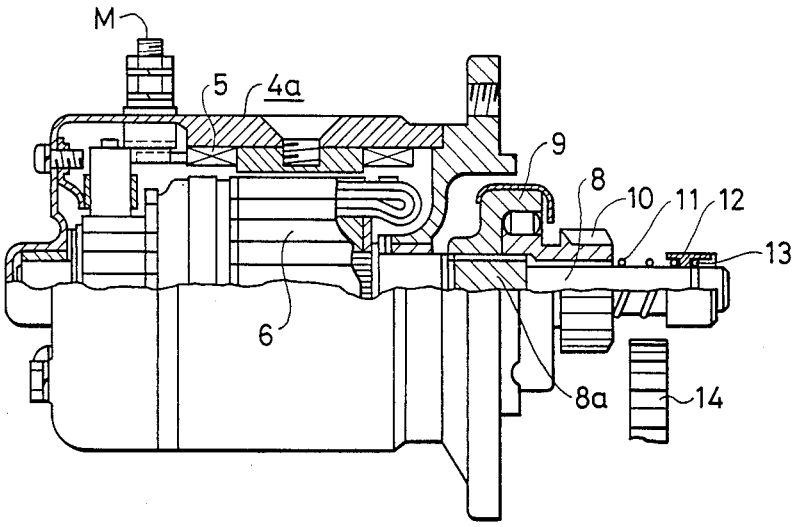
FIG. 1 PRIOR ART
FIG. 1 is a front view, with its upper portion sectioned, showing a conventional starter.

As the pinion 10 is moved as described, the lower end portion of the drive lever 20 is moved by its left, lower side 20*b* by the collar 22 of the thrust spline member 9 to the right. That is, the drive lever 20 is turned about the fulcrum 20*d* so that the upper end portion 20*a* of the drive lever 20 is moved to the left. As a result, the return spring 11*a* is compressed so that the inner end face of the drive rod 21 comes near the wall of the hollow Y in the plunger. In this connection, the dimension L is set to a value near zero (0) so that the amount of movement of the drive rod 21 to the left provided when the pinion 10 is moved maximally to the right is larger than the amount of movement (X) of the plunger 3*e*. Therefore, even if the pinion 10 tends to return to the left earlier because of the pulsive motion of the engine, a right, lower side 20*c* of the lower end portion of the drive lever 20 regulates the movement of the thrust spline member 9 thereby to prevent the early return of the pinion 10. Further, since the rod 21 is formed of a magnetic material, the rod is attracted by the plunger 3*e* to a position adjacent the end face ($L \approx 0$) of the plunger. Therefore, even if the pinion 10 tends to return to the left as was the case in the prior art of FIG. 1, early disengage from the ring gear and prematurely return of the rod and therefore the ring gear is prevented because of the magnetic attractive force.

When the key switch 2 is turned off after the engine has been started in the above-described manner, the switch coil 3*d* is deenergized, so that the plunger 3*e* is returned to its original position on the right by the plunger spring 19. As a result, the movable contact 3*c* is disengaged from the pair of stationary contacts 3*a* and 3*b*, thus interrupting the supply of current to the starter 4*b*. In this operation, the drive rod 21 is pushed to the right by the return spring 11*a*, so that the upper end portion 20*a* of the drive lever 20 is moved to the right. Accordingly, the lower end portion of the drive lever 20 moves the thrust spline member 9 to the left with its left lower side 20*b*. As a result, the pinion 10 is disengaged from the ring gear 14 of the engine and returned to the original position. At the same time, the friction between the collar 22 and the right, lower side 20*b* of the lower end portion of the drive lever 20 and that between the collar 22 and the thrust spline member 9 act as braking force, thus reducing the time required for stopping the armature.

As was described above, according to the invention, the return spring 11a adapted to urge the pinion 10 to move away from the engine ring gear 14 and the drive rod 21 adapted to drive the drive lever 20 to move the pinion 10 are accommodated inside the plunger 3*e*. This construction eliminates the difficulties accompanying the conventional starter that dust or water entering the starter makes the sliding operation of the return spring unsatisfactory, or corrodes and breaks it, and the pinion is returned earlier by the pulsive motion of the engine. Furthermore, the time required for stopping the armature can be reduced according to the invention. These effects should be highly appreciated in practical use.

What is claimed is:

1. A starter comprising:

a motor comprising an armature and a field coil;

an output shaft connected to said armature;

a pinion coupled to said output shaft and movable therealong to selectively rotatably engage a ring gear, thereby transmitting rotational power of said output shaft to said ring gear;

an electromagnetic switch mounted on said motor and including a solenoid plunger;

a drive lever pivotally mounted on said motor and having one end coupled to said pinion in a direction of an axis of said output shaft;

a drive rod for driving the other end of said drive lever and being slidably accommodated in said plunger and being magnetically attractable to said plunger; and a return spring for biasing said drive rod to thereby bias said pinion away from said ring gear and being accommodated in said plunger.

2. A starter as recited in claim 1, wherein said electromagnetic switch controls a supply of electrical power to said armature and said field coil.

3. A starter as recited in claim 1, further comprising a thrust spline member rigidly connected with said pinion and slidably mounted on helical splines formed on said output shaft and wherein said one end of said drive lever is mounted on said thrust spline member.

4. A starter as recited in claim 11, wherein said plunger includes a hollow and said return spring and at least part of said drive rod are contained in said hollow.

5. A starter as recited in claim 4, wherein said electromagnetic switch contains a first stationary not shown contact connected to a power supply terminal, a second stationary contact connected to one of said armature and field coil and a movable contact translated by said plunger to electrically connect said first and second stationary contacts which moved in a first direction and wherein said drive rod partially projects from said hollow in a second direction opposite said first direction and wherein said return spring is a compression spring biasing said drive rod against said plunger in said second direction.

6. A starter as recited in claim 1, wherein said magnetic attraction between said drive rod and said plunger is sufficient to prevent said pinion from disengaging from said ring gear while said electromagnetic switch is in an on position.

* * * * *